United States Patent [19]

Parsons

[11] Patent Number: 5,027,946

[45] Date of Patent: Jul. 2, 1991

[54] DUAL ELEMENT WRAPPER AND SHROUD FOR SHINGLE BUNDLES

[75] Inventor: William B. Parsons, Sylvania, Ohio

[73] Assignee: Owens-Corning Fiberglas Corporation, Toledo, Ohio

[21] Appl. No.: 509,104

[22] Filed: Apr. 13, 1990

Related U.S. Application Data

[63] Continuation-in-part of Ser. No. 407,603, Sep. 15, 1989, abandoned.

[51] Int. Cl.[5] ..... B65D 85/46

[52] U.S. Cl. ..... 206/323; 206/497; 206/524.9; 206/597; 229/87.01; 428/920

[58] Field of Search ..... 206/323, 324, 524.2, 206/524.9, 525, 451, 497, 597; 220/450, DIG. 9; 428/212, 516, 920; 229/87.01, 87.08

[56] References Cited

U.S. PATENT DOCUMENTS

| | | | |
|---|---|---|---|
| 1,599,026 | 9/1926 | Markert | 206/451 |
| 1,604,183 | 10/1976 | Markert | 206/323 X |
| 2,026,282 | 12/1935 | Legvillon | 206/232 X |
| 2,885,073 | 5/1959 | Bettoli et al. | 206/597 X |
| 3,011,631 | 12/1961 | Sider | 206/323 |
| 3,092,503 | 6/1963 | Plummer | 428/920 X |
| 3,138,251 | 6/1964 | Olszyk et al. | 206/324 |
| 3,247,006 | 4/1966 | Hoge et al. | 428/920 X |
| 3,366,233 | 1/1968 | Roediger | 206/524.2 |
| 4,203,521 | 5/1980 | Dunn | 229/87.01 X |
| 4,429,794 | 2/1984 | Steger et al. | 206/597 |
| 4,750,668 | 6/1988 | Behue et al. | 229/87.08 |

FOREIGN PATENT DOCUMENTS

| | | | |
|---|---|---|---|
| 2658631 | 6/1978 | Fed. Rep. of Germany | 229/87.08 |

OTHER PUBLICATIONS

Arbrene Lumber Wrap Catalog, DuPont, Danada, (1-84).

Owens-Corning Fiberglas Corporation Test Results of Effects of Sunlight on Shrouds for Bundles of Shingles (Jun. 12, 1990).

*Primary Examiner*—Byron P. Gehman

*Attorney, Agent, or Firm*—Patrick P. Pacella; Ted C. Gillespie

[57] ABSTRACT

An improved wrapper or shroud for packaging shingles which is composed of a heat reflective layer and a heat absorptive layer. The wrapper enhances temperature reduction in packages of shingles exposed to high ambient temperatures.

14 Claims, 5 Drawing Sheets

DUAL ELEMENT WRAPPER AND SHROUD FOR SHINGLE BUNDLES

This is a continuation-in-part of U.S. patent application Ser. No. 07/407,603, filed Sep. 15, 1989, now abandoned.

TECHNICAL FIELD

This invention relates to improved wrappers and shrouds for use in packaging, shipping and storing shingles. In particular, the invention is directed toward use of heat deflecting wrappers and shrouds designed for use with bundles of self-sealing shingles wherein the temperature within the bundle of shingles is maintained at a substantially lower temperature than that temperature previously achieved with prior wrappers or shrouds.

BACKGROUND OF THE INVENTION

Shingles intended for use in such applications as roofing and siding building materials have developed so that most commonly available shingle products now have a self-sealing adhesive layer or strip located upon a major surface of each shingle product. The adhesive or sealant which is placed upon the shingle during the manufacturing process is temperature sensitive and the sealant will activate when a specified threshold temperature is met. The threshold or activation temperature for the sealant can be selected to closely correlate with the expected ambient temperature of the specific geographical area in which the shingles are expected to be used. Usually the activation temperature will be selected to be from 20°-60° F. higher than the expected ambient temperature. When the shingles are applied during building construction the shingle will heat up as a result of solar heat absorption and activate the adhesive. The weight of the shingles will then seal the shingles together.

Problems have been encountered in packaging such self-sealing shingles in that the shingles are often left outdoors at a construction site, or a shingle manufacturer's or retailer's storage yard. These shingles will often be exposed to solar heat ambient temperatures which may activate the sealant causing the shingles to adhere to each other. Solar heat, if not deflected from the shingles, will be absorbed by the shingle products causing the bundle of shingles to reach a temperature substantially higher than ambient. If the temperature within the bundle reaches the tab sealant activation level, the sealant will become tacky and the shingles, stacked upon each other, will adhere to one another. Thus problems are created when the shingles are stored outdoors prior to use in construction.

There are specific packaging efforts which have been directed at solving this problem of self-sealing adhesion during shingle storage. For instance, U.S. Pat. No. 3,138,251 offers a solution to the problem through the use of a light cardboard-type wrapper which is folded over the bottom, sides and ends of the bundle of shingles. The wrapper ends are folded upon themselves and mated with the uppermost shingle in the bundle to cover a substantial portion of the head and butt portions of the shingles and create a gap between the folded ends. As the shingles are stacked, the adhesive strips are in approximate alignment adjacent the area of the gap thereby separating the adhesive portions of each shingle from the other shingles resting upon it. This type of packaging, however, has proven to be costly and time consuming in its application.

A more commonly accepted method for wrapping shingle bundles is to cover the bundles with a paper wrapper. This type of wrapper, while offering brief insulating properties from exposure to solar heat, often fails to maintain the interior temperature of a bundle of shingles at a sufficiently low temperature to avoid activating the self-sealing adhesive. A release paper or film is commonly placed over the sealant strips when the shingles are stacked in a bundle. Even though a release paper is used, under certain storage conditions the shingles will still adhere to each other in the bundle.

Another problem with high temperatures due to solar heating under storage conditions is staining of the lighter colors of shingles, particularly the white shingles. It may be that the hot temperatures cause some of the oils to seep out from the base asphalt of the shingle. Prevention of extremely hot temperatures from solar loading will help alleviate this staining problem.

Recent attempts to enhance the packaging of shingle bundles have focused on the use of polyethylene films as packaging material. It is known that white polyethylene film and clear polyethylene film have been used. However, these films have shown no success in reducing the interior heat of the shingle bundle. In fact, tests have shown that both white and clear wrappers actually increase the interior heat of a bundle when compared to a paper wrapper.

Therefore, it is an object of this invention to facilitate ease of packaging of shingle bundles and pallet loads of shingle bundles.

It is a further object of this invention to package shingle bundles and pallet loads of shingle bundles in such a manner that the adhesive portions of the self-sealing shingles are maintained at a temperature which will be low enough so as not to cause the individual shingles to adhere to one another, even when exposed to solar heat.

SUMMARY OF THE INVENTION

The present invention provides a dual element wrapper or shroud consisting of a heat reflective outer layer and a heat absorptive inner layer for use in wrapping bundles of shingles or for use as a shroud for pallets containing many bundles of shingles or other roofing products. The wrapper and shroud are designed to deflect sufficient heat from the packaged shingles to reduce the temperature build-up in a bundle of shingles to prevent or minimize the temperature activated shingle sealant from causing the shingles to adhere to one another. The shingle wrapper and shroud are composed of an outer layer designed to reflect a substantial portion of the incoming heat and an inner layer which absorbs the remaining heat and causes it to scatter. The wrapper is effective in reducing the temperature build-up on the interior surface of a bundle of shingles because the two-layer combination prevents the penetration of a sufficient amount of infrared light rays to overheat the package.

According to this invention, there is provided a bundle of shingles wrapped in a dual element wrapper comprised of an outer layer of heat reflective material and an inner layer of heat absorptive material.

In a specific embodiment of the invention, the outer layer has an opacity of at least 30 percent and the inner layer has an opacity of at least 75 percent.

In another specific embodiment of the invention, the inner and outer layers are comprised of heat shrinkable plastic film. Preferably the film is a coextruded film. Most preferably the film is a coextruded polethylene film, with the inner and outer layers being coextruded to nearly equal thicknesses.

In another embodiment of the invention, the outer layer is white in color and the inner layer is silver in color.

In another embodiment of the invention, the inner and outer layers yield an overall opacity of at least 90 percent.

According to this invention, there is also provided a pallet load of bundles of shingles covered by a shroud, where the shroud is comprised of an outer layer of heat reflective material and an inner layer of heat absorptive material.

In a specific embodiment of the invention, the shroud outer layer has an opacity of at least 30 percent and the shroud inner layer has an opacity of at least 75 percent.

In another specific embodiment of the invention, the shroud inner and outer layers are comprised of a plastic film. Most preferably the film is a coextruded polethylene film, with the shroud outer layer being about three mils thick and the shroud inner layer being about one mil thick.

In an additional embodiment of the invention, the shroud outer layer is white in color and the shroud inner layer is silver in color.

In another embodiment of the invention, the shroud inner and outer layers yield an overall opacity of at least 90 percent.

DETAILED DESCRIPTION OF THE PREFERRED EMBODIMENT

Figure 1:
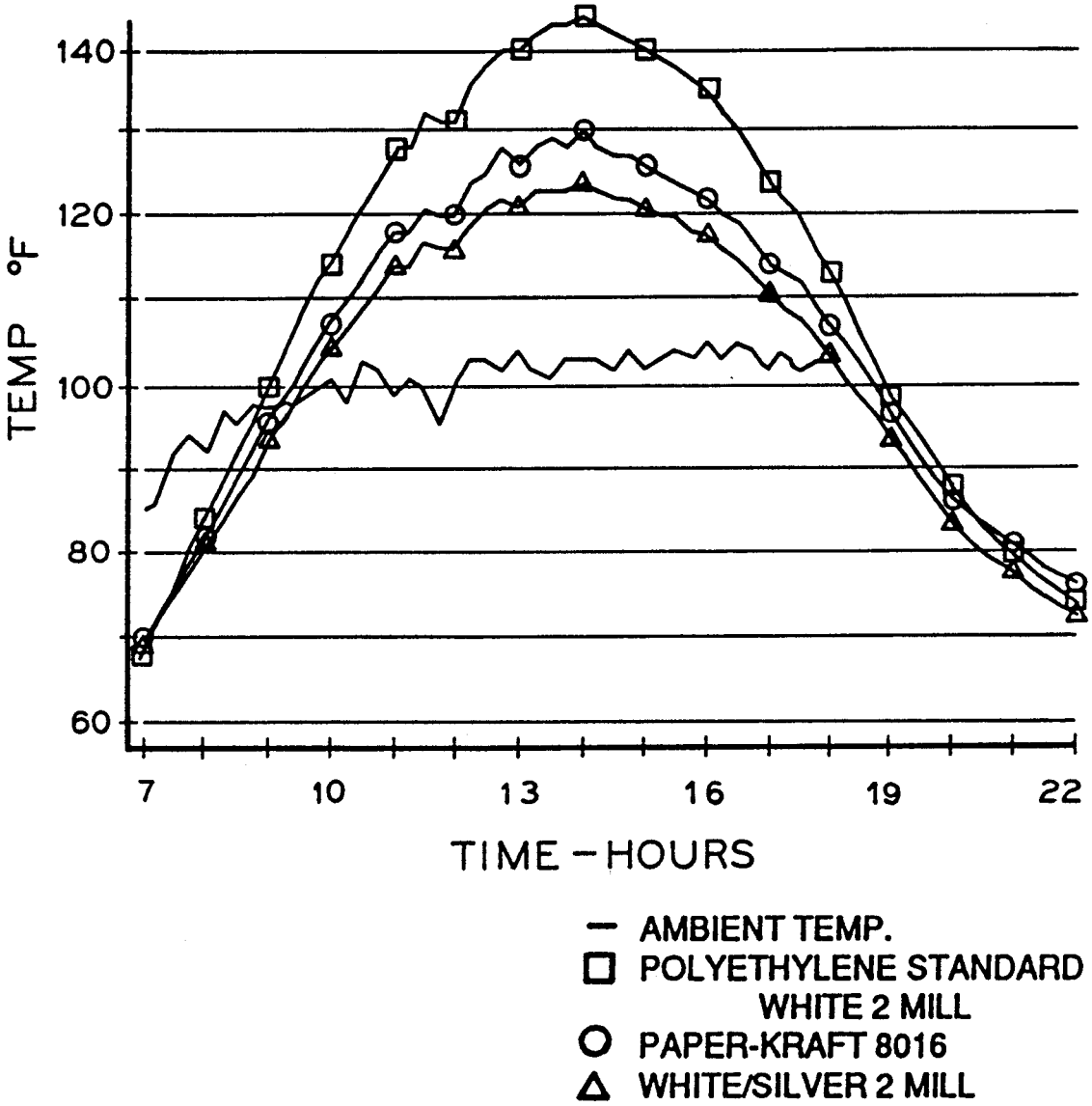
FIG. 1 is a graph showing the temperature over time of a top shingle in a bundle and comparing the invention with a known paper wrapper and a known polyethylene wrapper.
Figure 2:
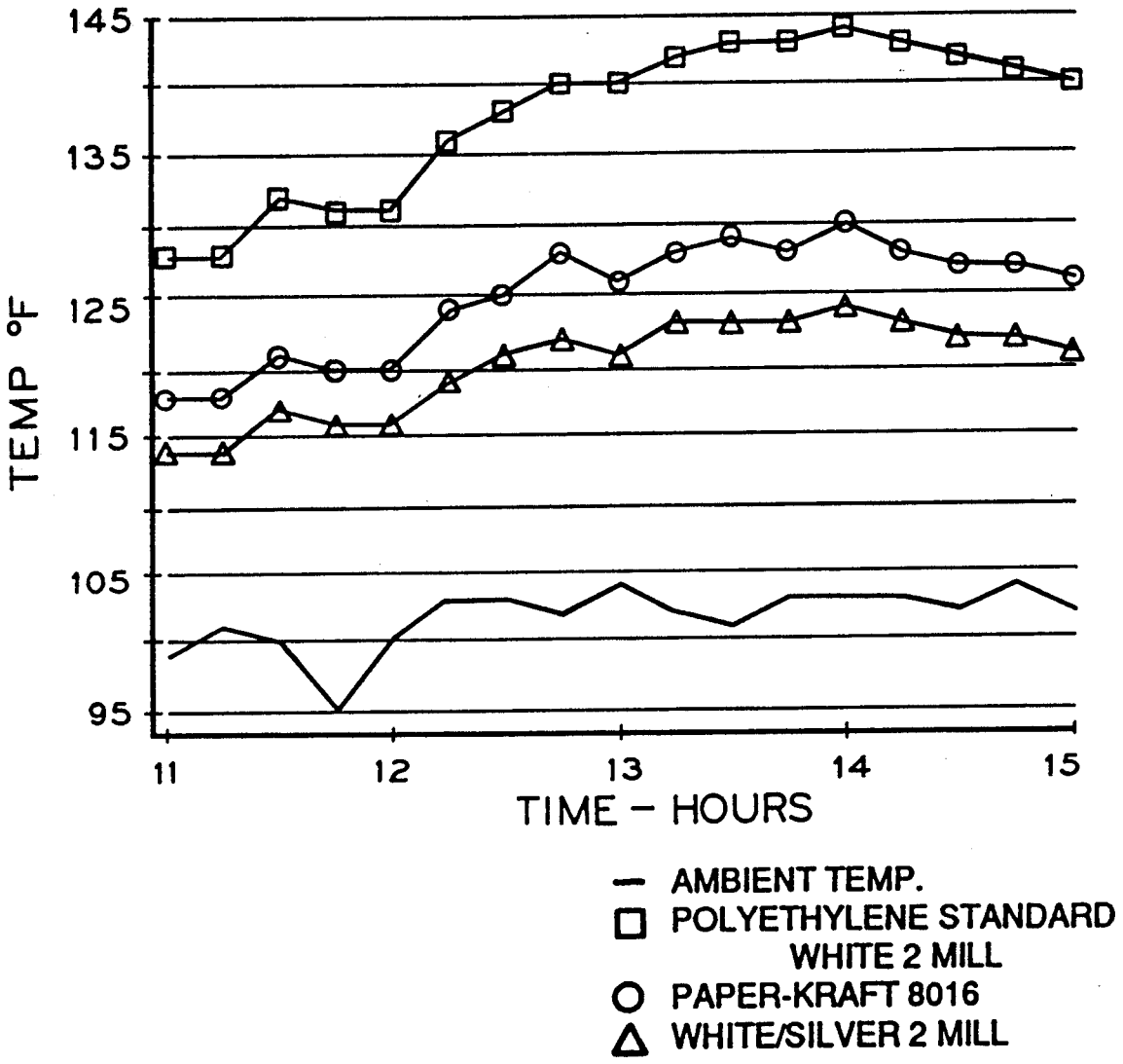
FIG. 2 is a close-up of FIG. 1 for the time interval from 11 to 15 hours.
Figure 3:
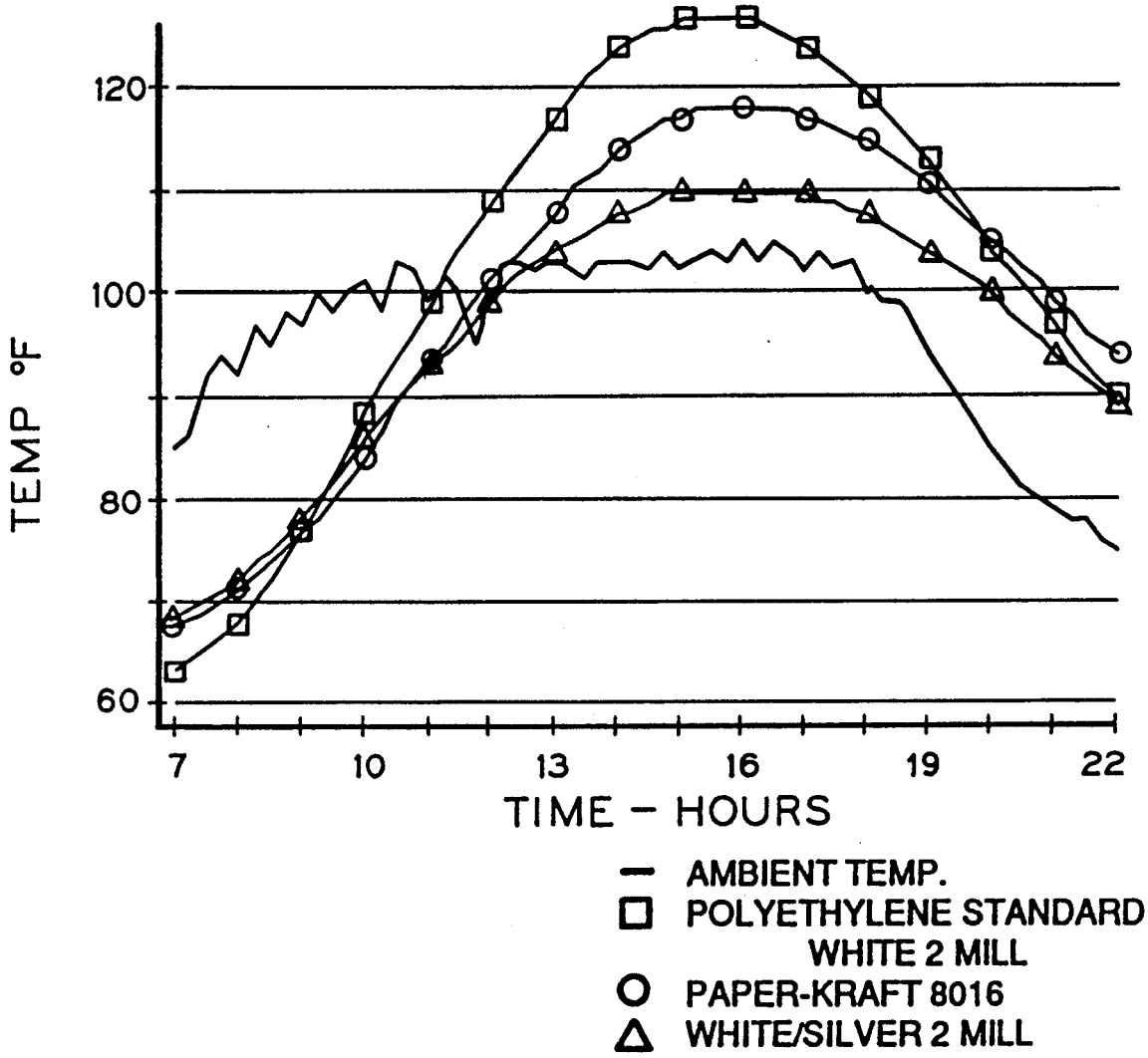
FIG. 3 is a graph showing the temperature over time for mid-bundle and comparing the invention with a known paper wrapper and a known polyethylene wrapper.
Figure 4:
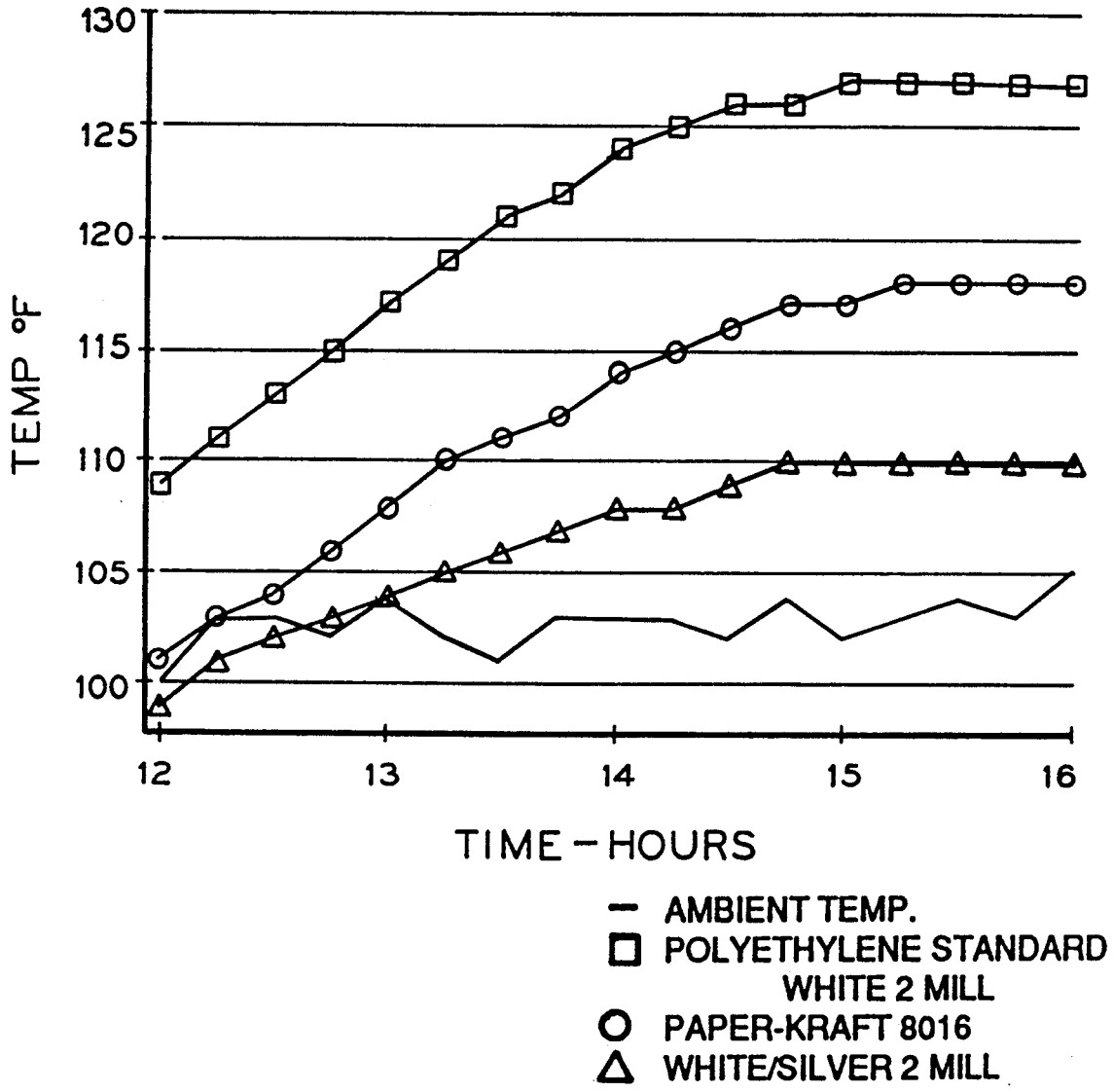
FIG. 4 is a close-up of FIG. 3 for the time interval from 12 to 16 hours.

The invention will be described in terms of packaging for shingles. As used herein, "shingles" includes any granule-covered roofing membranes, whether in the form of individual shingle pieces, or in the form of a rolled granule-covered roofing sheet.

The wrapper and shroud of the present invention are comprised of two elements: a reflective outer layer and an absorptive inner layer. The outer layer is usually of a light color designed to enhance its reflective qualities. It is preferable that the outer layer be capable of reflecting at least 50% of the radiant heat contacting it. It is believed that the use of a light color enables the outer layer to reflect visible light and long infrared waves. The second or inner layer, composed of a highly absorptive material, receives the remaining heat, usually composed mainly of short infrared waves which are not as powerful as the long infrared waves. The second layer absorbs a portion of the short infrared waves and causes them to scatter, thereby reducing the rate of heat transfer into the shingles.

In the preferred embodiment of the present invention, the wrapper or shroud is a film composed of a dual-layer film such as polyethylene. In the case of a shingle wrapper, the film is preferably heat-shrinkable. In addition to polyethylene, it is envisioned that the invention can be achieved with other forms of plastic film and with paper having a specific coating of absorptive material. For example, PVC, polyolefin, ethylene vinyl acetate and blends of these materials could be used. The invention can also be practiced using a lamination of two layers: one reflective and one absorptive.

The films of the present invention are preferably composed of a light colored outer layer, usually white, and an absorptive inner layer having a gray or silver color. There is nothing intended to be limiting by the selection of these colors as it is envisioned that any appropriate combination of reflective and absorptive colors will achieve the invention. Also, it is to be understood that the use of the term "silver" includes like colors, including gray.

In the preferred embodiment, the film of the present invention is composed of coextruded polyethylene film having a white outer layer and a silver inner layer. Each layer is 1 mil in thickness. It is clear that film products of alternative thicknesses may be successfully used. The inner and outer layers need not necessarily be of equal thickness. In the preferred embodiment of the shroud, an outer white layer is 3 mils thick and an inner silver layer is 1 mil thick.

The opacity of the white outer layer, a measure of reflectance as measured in accordance with the D1003-61 ASTM test for opacity, should be at least 30%, preferably, at least 45% and, most preferably, around 70%. Increased opacity of the white layer can be produced by doping the film during manufacture with additional pigment, such as titanium dioxide.

The opacity of the silver layer, a measure of absorption, as measured in accordance with the D1003-61 ASTM test for opacity, should be at least 75% and, preferably, around 90%. The silver color is achieved by the addition of aluminum powder pigment to the polyethylene resin. The preferred combination will result in an overall opacity measurement of 90%–93%. However, opacity measurements above 70% may be effective. Measuring the overall opacity of a dual layer coextruded film is readily determined by the ASTM test. The opacity of a single layer of a dual layer film must be determined by assessing the pigment loading of the material in that layer during the manufacturing process.

Referring to the Figures, it can be seen that the present invention has been found to be more effective in reducing temperature build-up in a bundle of shingles than the commonly used paper wrapper and the current polyethylene wrappers. The data shown in FIGS. 1-4 reflects tests conducted in direct sunlight in Phoenix, Ariz. The ambient temperature reached highs of about 105° F. It can be seen that the dual element wrapper of the present invention achieved substantially greater success in maintaining lower temperatures within the bundle of shingles than the paper and single layer polyethylene wrappers.

Figure 5:
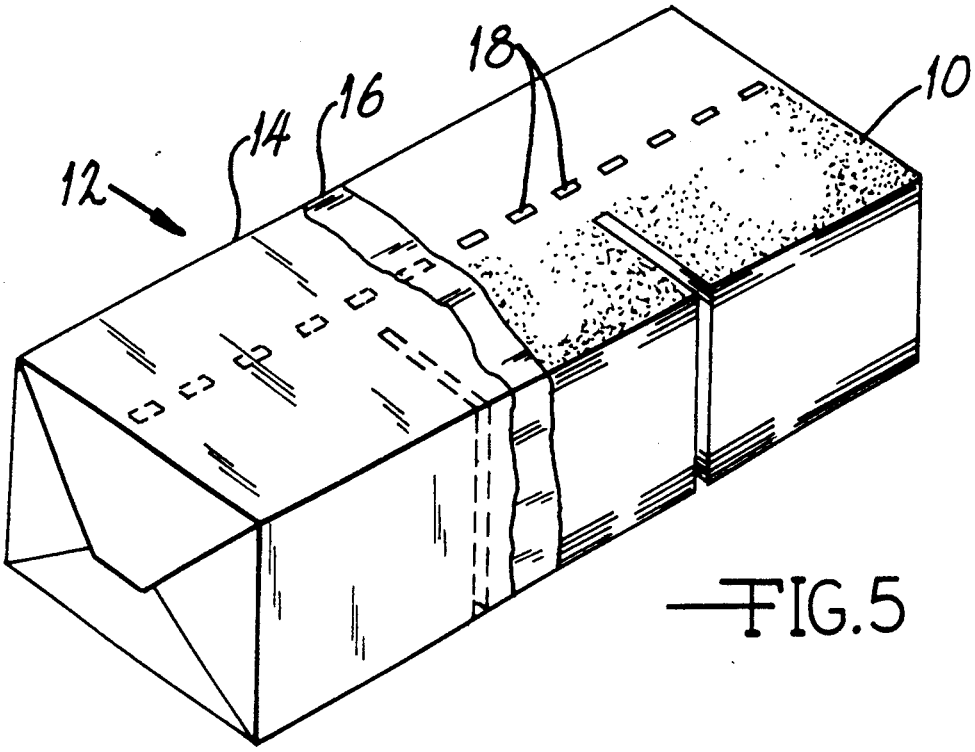
FIG. 5 is a partially cut away perspective view of a bundle of shingles having a wrapper of the present invention.

Referring to FIG. 5, bundle of shingles 10 is shown as being covered with wrapper 12, which is a dual element wrapper comprised of a coextruded outer layer 14 of white polyethylene and inner layer 16 of silver polyethylene. Each shingle has a row of tab sealant applications 18 suitable for sealing the tabs of the shingles on the roof.

Figure 6:
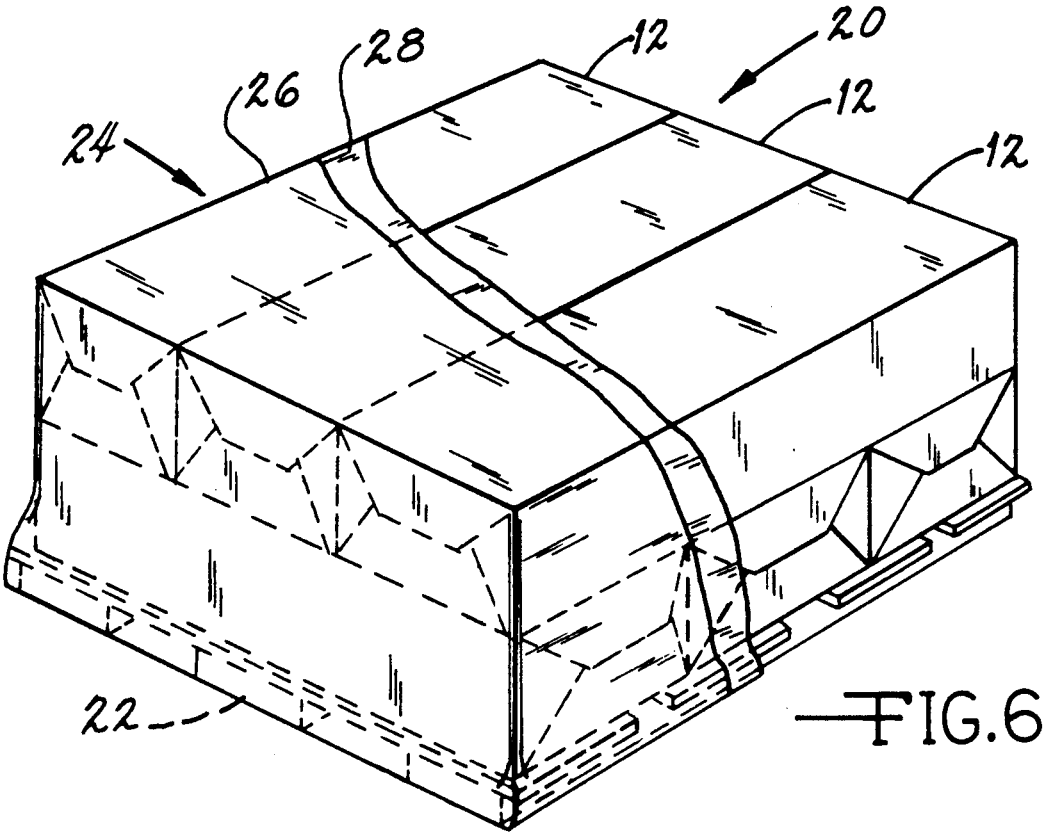
FIG. 6 is a partially cut away view of a pallet load of bundles of shingles covered with a shroud of the present invention.

Referring to FIG. 6, pallet load 20 consists of pallet 22 of bundles of shingles covered by shroud 24, which is a coextruded outer layer 26 of white polyethylene and inner layer 28 of silver polyethylene. It is to be understood that as used herein, the term "pallet load of bundles of shingles" refers to any stack, pile or assembly of bundles of shingles, whether or not they are actually placed on a pallet.

The preferred embodiment of the present invention has been described for illustrative reasons and is not intended to be limiting upon the scope and content of the following claims.

I claim:

1. A bundle of shingles wrapped in a dual element wrapper comprised of an outer layer of heat reflective plastic film having an opacity of at least 45 percent and an inner layer of heat absorptive plastic film having an opacity of at least 90 percent, the outer layer being capable of reflecting at least 50 percent of the radiant heat contacting it.

2. The bundle of shingles of claim 1 in which the film is a coextruded film.

3. The bundle of shingles of claim 2 in which the film is a coextruded polethylene film.

4. The bundle of shingles of claim 2 in which the outer layer is white in color and the inner layer is silver in color.

5. The bundle of shingles of claim 4 in which the film is a coextruded polyethylene film with the inner and outer layers being coextruded to nearly equal thicknesses.

6. The bundle of shingles of claim 5 in which the inner and outer layers yield an overall opacity of at least 90 percent.

7. The bundle of shingles of claim 2 in which the plastic film is a heat shrinkable plastic film.

8. A pallet load of bundles of shingles covered by a shroud, wherein the shroud is comprised of an outer layer of heat reflective plastic film having an opacity of at least 45 percent and an inner layer of heat absorptive plastic film having an opacity of at least 90 percent, the outer layer being capable of reflecting at least 50 percent of the radiant heat contacting it.

9. The pallet load of claim 8 in which the film is a coextruded film.

10. The pallet load of claim 9 in which the film is a coextruded polyethylene film.

11. The pallet load of claim 9 in which the shroud outer layer is white in color and the shroud inner layer is silver in color.

12. The pallet load of claim 11 in which the film is a coextruded polyethylene film with the shroud inner and outer layers being coextruded to nearly equal thicknesses.

13. The pallet load of claim 11 in which the film is a coextruded polyethylene film with the shroud outer layer being about three mils thick and the shroud inner layer being about one mil thick.

14. The pallet load of claim 13 in which the shroud inner and outer layers yield an overall opacity of at least 90 percent.

* * * * *